US011841120B2

(12) United States Patent
Lim

(10) Patent No.: US 11,841,120 B2
(45) Date of Patent: Dec. 12, 2023

(54) LIGHT-DISTRIBUTING LENS AND LIGHTING MODULE USING THE SAME

(71) Applicants: HYUNDAI MOTOR COMPANY, Seoul (KR); KIA CORPORATION, Seoul (KR)

(72) Inventor: Jung Wook Lim, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/726,635

(22) Filed: Apr. 22, 2022

(65) Prior Publication Data

US 2022/0243889 A1 Aug. 4, 2022

Related U.S. Application Data

(63) Continuation-in-part of application No. 17/191,086, filed on Mar. 3, 2021, now Pat. No. 11,346,516.

(30) Foreign Application Priority Data

Oct. 6, 2020 (KR) ..... 10-2020-0128949
Jul. 6, 2021 (KR) ..... 10-2021-0088478

(51) Int. Cl.
*F21S 41/265* (2018.01)
*F21S 41/32* (2018.01)
*F21S 41/24* (2018.01)

(52) U.S. Cl.
CPC ..... *F21S 41/265* (2018.01); *F21S 41/24* (2018.01); *F21S 41/322* (2018.01)

(58) Field of Classification Search
CPC .... F21W 2102/13; F21V 5/045; F21V 7/0091
See application file for complete search history.

(56) References Cited

U.S. PATENT DOCUMENTS

| | | | | |
|---|---|---|---|---|
| 8,104,939 | B2 * | 1/2012 | Coushaine | F21S 41/24 362/545 |
| 9,701,240 | B2 * | 7/2017 | Matsumaru | G02B 19/0028 |
| 10,253,940 | B1 * | 4/2019 | Shih | F21S 41/663 |
| 10,300,835 | B2 | 5/2019 | Mochizuki | |
| 10,436,406 | B2 | 10/2019 | Okada | |
| 10,761,243 | B1 | 9/2020 | Wei | |
| 10,908,345 | B2 | 2/2021 | Vollmer | |
| 2005/0270791 | A1 * | 12/2005 | Lee | F21S 41/143 362/521 |
| 2010/0135036 | A1 * | 6/2010 | Matsuba | F21S 41/322 362/516 |
| 2014/0192547 | A1 * | 7/2014 | Kumar | F21S 43/40 362/522 |
| 2015/0078029 | A1 * | 3/2015 | Kumar | F21S 41/336 362/522 |

(Continued)

FOREIGN PATENT DOCUMENTS

| | | | |
|---|---|---|---|
| KR | 100803310 | B1 | 2/2008 |
| KR | 20180134498 | A | 12/2018 |

*Primary Examiner* — Zheng Song
(74) *Attorney, Agent, or Firm* — LEMPIA SUMMERFIELD KATZ LLC

(57) ABSTRACT

Disclosed are a light-distributing lens and a lighting module using the same, which are capable of securing light efficiency when implementing a low beam and of having enhanced light performance by eliminating unintentional generation of light.

7 Claims, 7 Drawing Sheets

(56) References Cited

U.S. PATENT DOCUMENTS

| | | | | |
|---|---|---|---|---|
| 2015/0241616 | A1* | 8/2015 | Bungenstock | G02B 6/0018 362/511 |
| 2015/0377453 | A1 | 12/2015 | Ji et al. | |
| 2016/0033101 | A1* | 2/2016 | Yan | F21S 41/143 362/520 |
| 2016/0311363 | A1* | 10/2016 | Ferigo | F21S 43/26 |
| 2017/0144589 | A1* | 5/2017 | Jung | F21S 41/265 |
| 2017/0205044 | A1* | 7/2017 | Tokieda | F21S 43/239 |
| 2017/0219178 | A1 | 8/2017 | Faffelberger et al. | |
| 2017/0336041 | A1* | 11/2017 | Mochizuki | F21S 41/24 |
| 2017/0336050 | A1 | 11/2017 | Lee | |
| 2018/0340666 | A1* | 11/2018 | Song | F21S 41/275 |
| 2019/0093847 | A1 | 3/2019 | Okada | |
| 2019/0154228 | A1 | 5/2019 | Xiang et al. | |
| 2019/0186708 | A1 | 6/2019 | Ecker-endl | |
| 2020/0300437 | A1* | 9/2020 | Nagaike | G02B 6/0068 |

* cited by examiner

LIGHT-DISTRIBUTING LENS AND LIGHTING MODULE USING THE SAME

CROSS-REFERENCE TO RELATED APPLICATIONS

This application is a continuation-in-part of U.S. patent application Ser. No. 17/191,086, filed on Mar. 3, 2021, which claims priority and the benefit of Korean Patent Application No. 10-2020-0128949, filed on Oct. 6, 2020, and Korean Patent Application No. 10-2021-0088478, filed on Jul. 6, 2021, the entire contents of each of which are incorporated herein by reference.

FIELD

The present disclosure relates to a light-distributing lens and a lighting module using the same.

BACKGROUND

The statements in this section merely provide background information related to the present disclosure and may not constitute prior art.

In general, a vehicle includes a lighting device for the purpose of making it easier to see objects in the driving direction thereof when driving at night and for the purpose of notifying other vehicles or other road users of the driving state of the vehicle. A lamp (also referred to as a headlamp) is lighting which functions to illuminate the path ahead of the vehicle provided therewith.

Examples of the lamp include a headlamp, a fog lamp, a turn signal lamp, a brake lamp, and a reverse lamp classified in different ways. These lamps are each set in a different direction for irradiating the road surface with light. For example, the headlamp emits a low beam in a normal driving situation, whereas it emits a high beam in a special situation.

Meanwhile, an optical system applied to future vehicles tends to decrease in overall size, and should require a sufficient amount of light.

In addition, the optical system has to implement a low beam even if it is slimmed down. However, when the optical system implements the low beam having a cut-off shape, the performance of the low beam may be deteriorated as light unintentionally travels above a cut-off line.

Moreover, if the optical system has an increased light distribution value in order to obtain a sufficient amount of light as the optical system is slimmed down, the amount of unintentional travel of light increases, making it difficult to secure the performance of the low beam.

The foregoing is intended merely to aid in understanding of the background of the present disclosure, and is not intended to mean that the present disclosure falls within the purview of the related art that is already known to those skilled in the art.

SUMMARY

The present disclosure provides a light-distributing lens and a lighting module using the same, which are capable of securing light efficiency when implementing a low beam and of having enhanced light performance by minimizing unintentional generation of light.

In an aspect of the present disclosure, a light-distributing lens includes: an incident surface on which light from a light source is incident and has a light guide slit formed thereon; and an exit surface through which the light is emitted. The light guide slit allows some of the incident light, directed upward or downward, to be emitted in a main optical direction.

The light guide slit may include an inclined section inclined in a central direction of the light-distributing lens and a straight section extending in a straight line.

The light guide slit may have a corner to which the inclined section and the straight section are connected, the corner being vertical in cross-section.

The inclined section may have an angular gradient such that the light directed from top to bottom or from bottom to top is refracted and emitted in the main optical direction.

The exit surface may have a plurality of cross-sectional parts protruding in a direction of emission of light, and the cross-sectional parts may have different protruding lengths.

The plurality of cross-sectional parts may be stepped due to the different protruding lengths thereof, so that a straight flat part is formed at the connection between each of the cross-sectional parts and a cross-sectional part adjacent thereto.

In one form, a plurality of light guide slits may be formed in the incident surface and arranged to match between the individual cross-sectional parts of the exit surface.

The light guide slit(s) may include a medium having a low refractive index.

In another aspect of the present disclosure, a lighting module includes: a light source configured to generate light; a first lens on which the light generated by the light source is incident and configured to change a travel direction of the light incident thereon; and a second lens including an incident surface on which the light having passed through the first lens is incident and has at least one light guide slit formed thereon; and an exit surface through which the light is emitted. The light guide slit allows some of the incident light, directed upward or downward, to be refracted.

The light guide slit may include an inclined section inclined in a central direction of the second lens and a straight section extending in a straight line.

A position where the light guide slit is formed may be determined according to the refractive index of the second lens and the angle at which the light having passed through the first lens is totally reflected in a vertical direction when incident on the incident surface.

In another form, a plurality of second lenses may be formed beneath the determined light guide slit.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The above and other objects, features and other advantages of the present disclosure should be more clearly understood from the following detailed description taken in conjunction with the accompanying drawings, in which.

The drawings described herein are for illustration purposes only and are not intended to limit the scope of the present disclosure in any way.

DETAILED DESCRIPTION

Hereinafter, a light-distributing lens and a lighting module using the same according to exemplary embodiments of the present disclosure are described with reference to the accompanying drawings.

Figure 1:
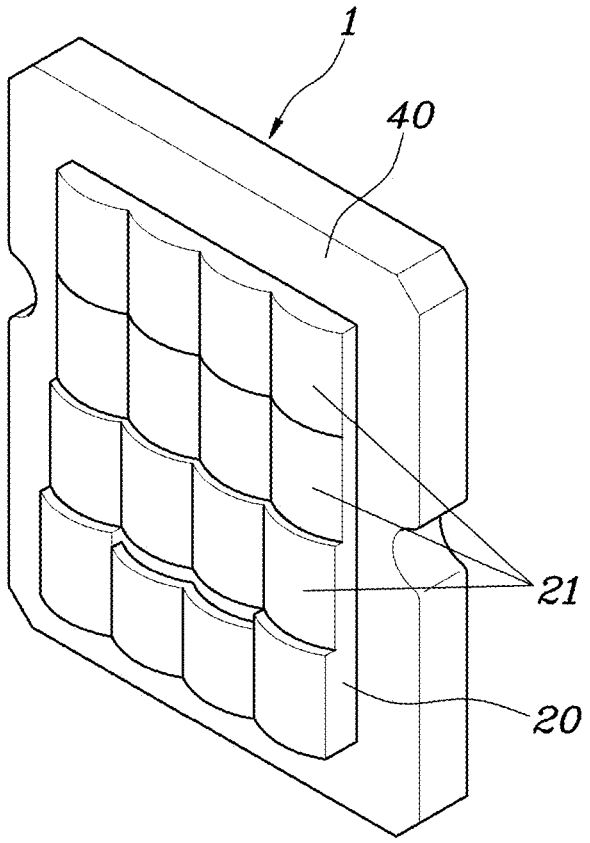
FIG. 1 is a view illustrating a light-distributing lens according to an embodiment of the present disclosure.
Figure 2:
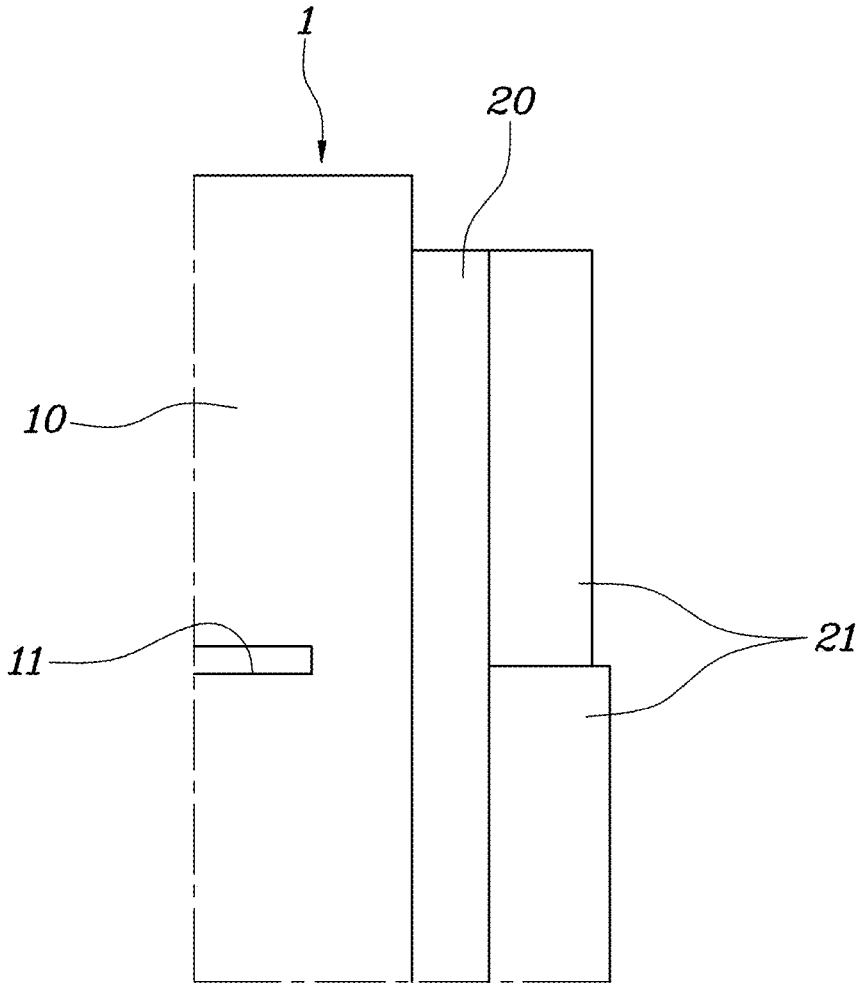
FIG. 2 is a side view of the light-distributing lens illustrated in FIG. 1.
Figure 3:
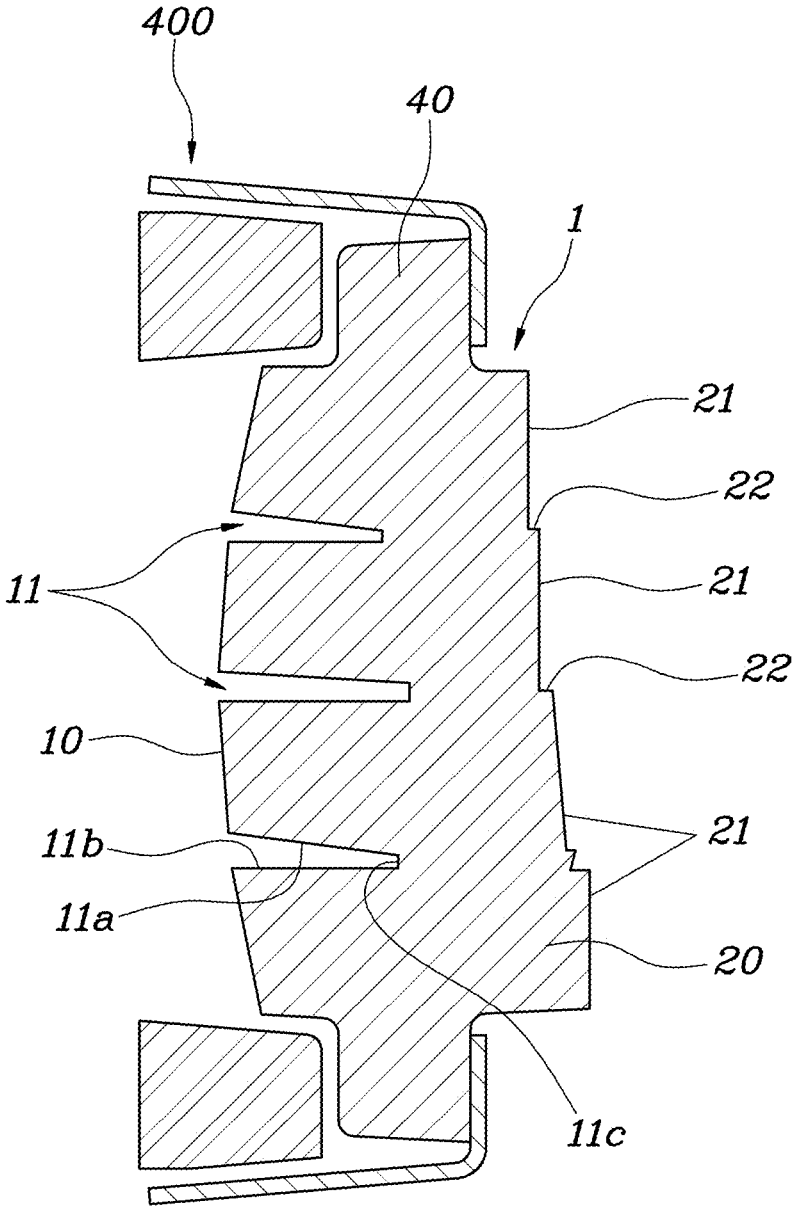
FIG. 3 is a view for explaining the light-distributing lens illustrated in FIG. 1.
Figure 4:
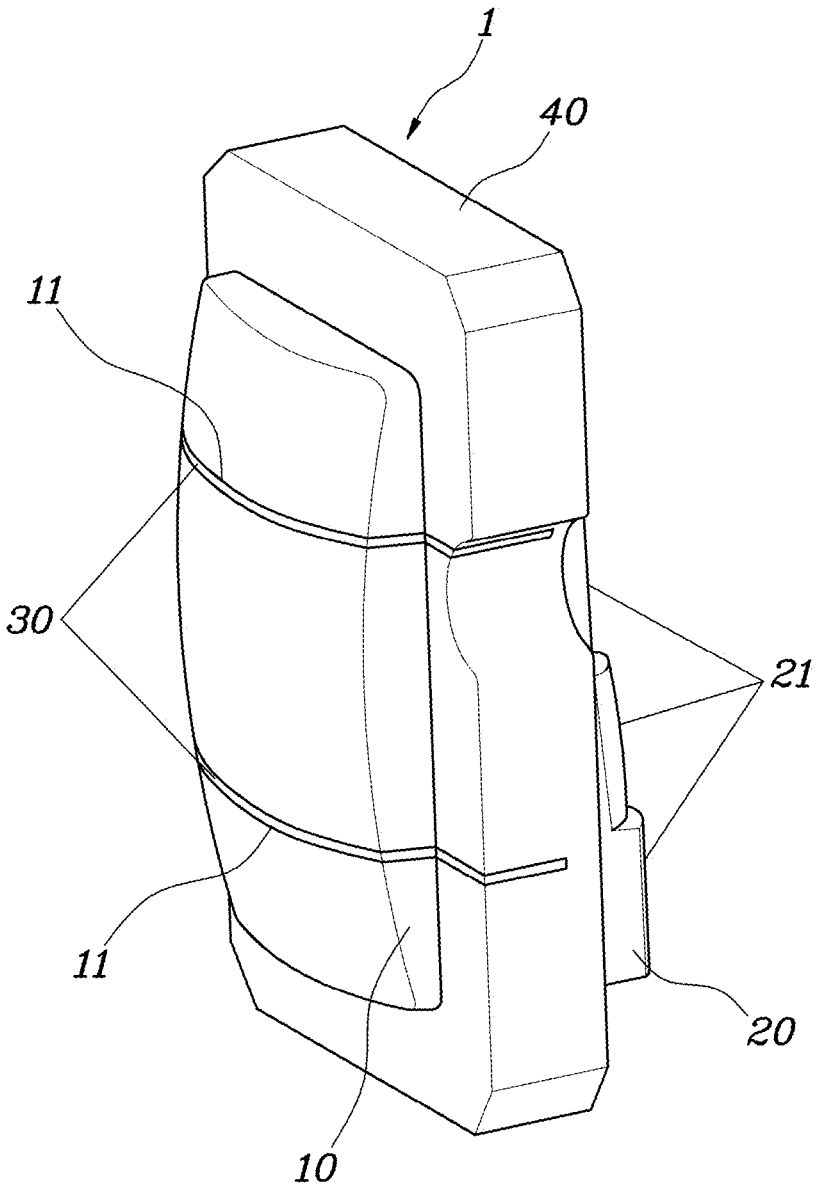
FIG. 4 is a view illustrating a medium in the light-distributing lens illustrated in FIG. 1.
Figure 5:
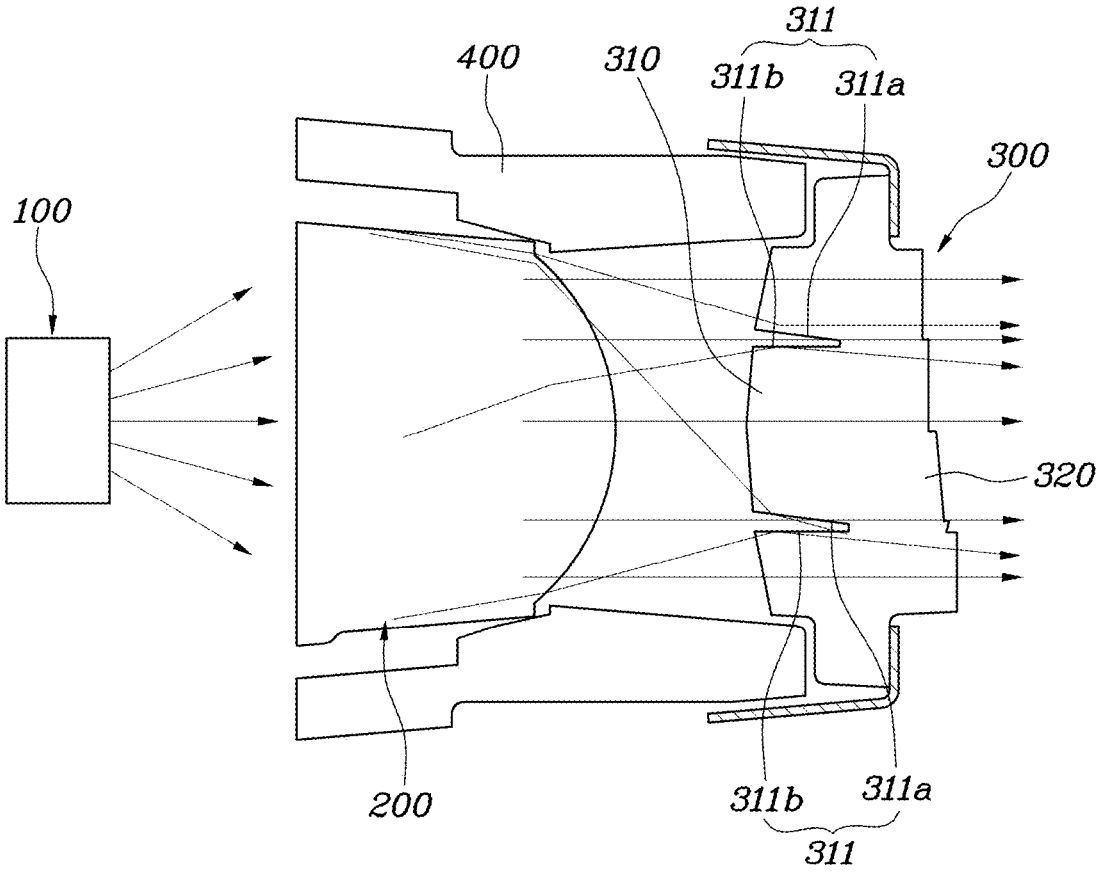
FIG. 5 is a view illustrating a lighting module having a light-distributing lens applied thereto according to an embodiment of the present disclosure.
Figure 6:
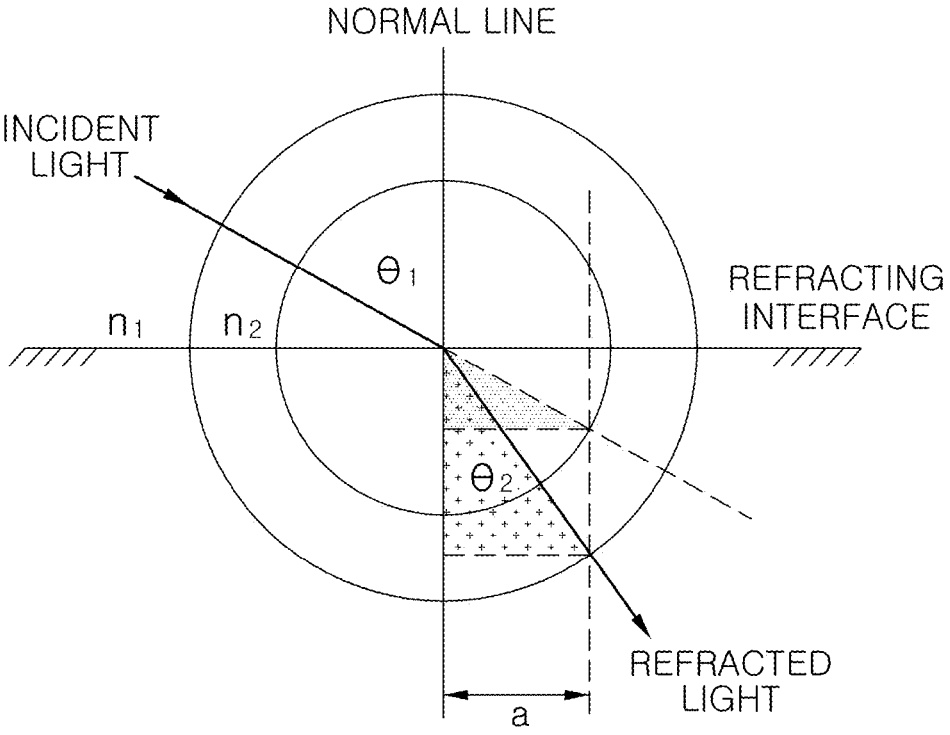
FIGS. 6 and 7 are views for explaining a position where a light guide slit is formed.
Figure 7:
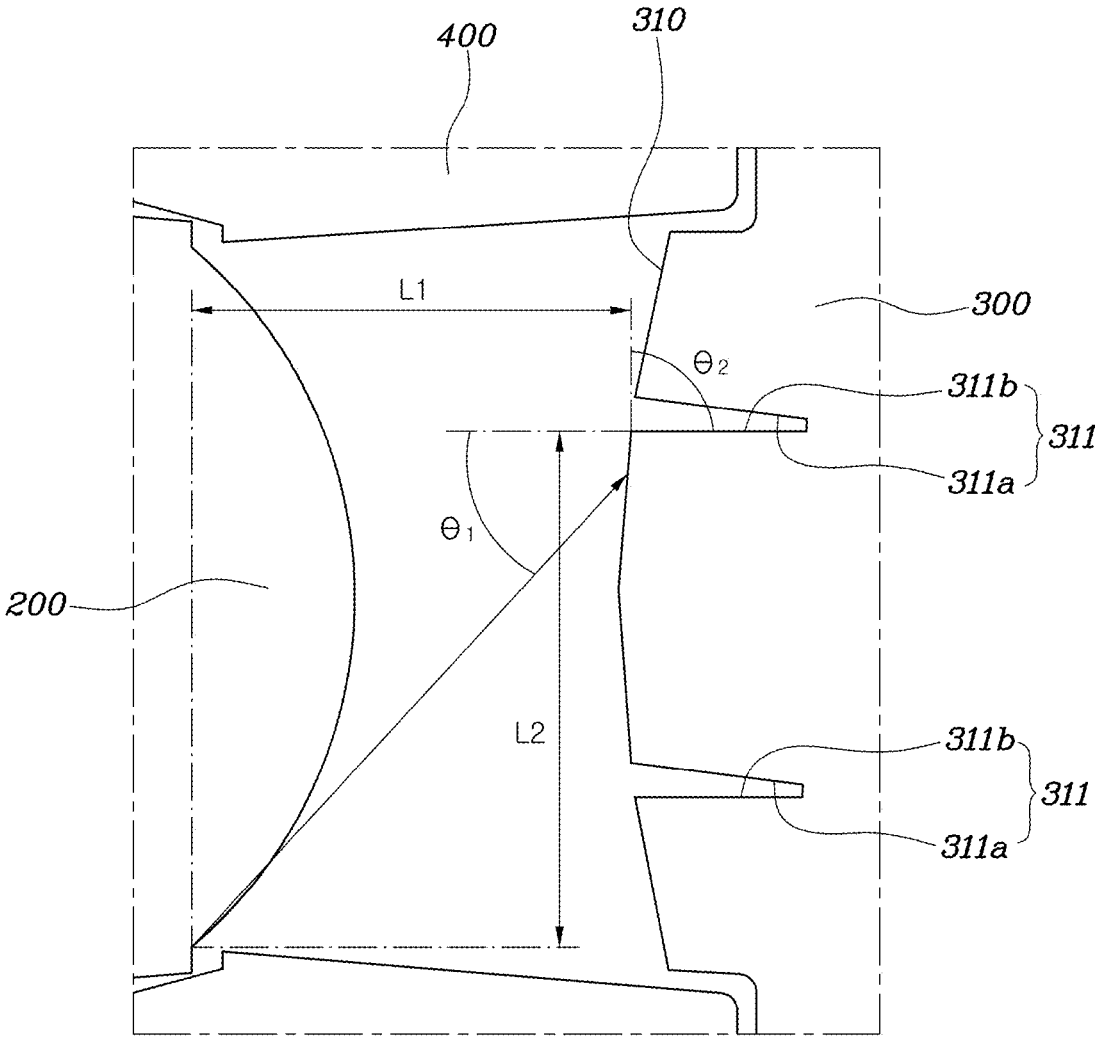

FIG. 1 is a view illustrating a light-distributing lens according to an embodiment of the present disclosure. FIG. 2 is a side view of the light-distributing lens illustrated in FIG. 1. FIG. 3 is a view for explaining the light-distributing lens illustrated in FIG. 1. FIG. 4 is a view illustrating a medium in the light-distributing lens illustrated in FIG. 1. FIG. 5 is a view illustrating a lighting module having a light-distributing lens applied thereto according to an embodiment of the present disclosure. FIGS. 6 and 7 are views for explaining a position where a light guide slit is formed.

The light-distributing lens, which is designated by reference numeral 1, according to the embodiment of the present disclosure is formed to refract incident light in a specific direction and to emit the refracted light in a main optical direction. Here, the main optical direction refers to a lighting region, and the light-distributing lens 1 may be applied to an optical system which implements high and low beams in a vehicle.

In particular, the light-distributing lens 1 minimizes upward travel of light through refraction thereof, thereby improving light performance during implementation of the low beam.

To this end, the light-distributing lens 1 has an incident surface 10 on which light from a light source 100 is incident and having at least one light guide slit 11 formed thereon, and an exit surface 20 through which the light is emitted. The light guide slit 11 allows some of the incident light, directed upward or downward, to be emitted in the main optical direction.

That is, as illustrated in FIG. 1, the light-distributing lens 1 has a thickness such that light travels in a specific direction, and has the incident surface 10 for incidence of light and the exit surface 20 for emission of light. The light-distributing lens 1 may be installed in a separate housing 400. When installed in the housing 400, the light-distributing lens 1 may have a fastening part 40 extending at the edge thereof so as not to interfere with the travel path of light.

In particular, the at least one light guide slit 11 is formed on the incident surface 10 of the light-distributing lens 1. The light guide slit 11 refracts some of the incident light, directed upward, to travel downward, and refracts some of the incident light, directed from top to bottom, to be emitted in the main optical direction.

As illustrated in FIG. 2, the light guide slit 11 has an inclined section 11*a* extending downwardly and obliquely with respect to an emission direction of light and a straight section 11*b* extending in a straight line.

That is, the light guide slit 11 is a portion cut to have the inclined section 11*a* and the straight section 11*b* on the incident surface 10 of the light-distributing lens 1, and defines a space with a low refractive index in the light-distributing lens 1.

In particular, the light guide slit 11 has the inclined section 11*a* inclined in the central direction of the light-distributing lens 1 and the straight section 11*b* extending in the straight line, so as to refract light through the inclined section 11*a* and the straight section 11*b*, thereby minimizing upward travel of light.

The inclined section 11*a* has an angular gradient such that the light directed from top to bottom or from bottom to top is refracted and travels in the main optical direction. If the gradient of the inclined section 11*a* is close to the straight section 11*b*, the light directed from top to bottom may be totally reflected in the inclined section 11*a* and may travel back upward.

Accordingly, the inclined section 11*a* of the light guide slit 11 has the angular gradient such that some of the light, directed from top to bottom or from bottom to top, is refracted in the main optical direction. The inclined section 11*a* of the light guide slit 11 may have an angle of inclination determined based on the travel path of light due to characteristics of the light source before the light-distributing lens 1 or the lens.

In this way, the light guide slit 11 is formed in the light-distributing lens 1 in order to secure light performance when implementing the low beam.

For example, some of the light passing through the light-distributing lens 1, directed from bottom to top, is not suitable for the low beam because of traveling above a cut-off line when the low beam is implemented. Accordingly, it is necessary to minimize some of the light passing through the light-distributing lens 1, directed from bottom to top.

To this end, in the light-distributing lens 1 of the present disclosure, the light guide slit 11 is formed on the incident surface 10, so that the light directed from bottom to top is totally reflected in the straight section 11*b* of the light guide slit 11 to travel downward, and some of the light passing therethrough is totally reflected in the inclined section 11*a* to travel downward, thereby minimizing upward travel of light.

In addition, the light directed from top to bottom is refracted by the inclined section 11*a* of the light guide slit 11 to travel forward, thereby achieving an improvement in light efficiency.

Meanwhile, the light guide slit 11 has a corner 11*c* to which the inclined section 11*a* and the straight section 11*b* are connected, the corner 11*c* being vertical in cross-section.

In this way, the light guide slit 11 has the corner 11*c* formed to have a vertical cross-section at the point where the end of the inclined section 11*a* meets the end of the straight section 11*b*, thereby enabling the light entering between the inclined section 11*a* and the straight section 11*b* to pass through the corner 11*c* and be emitted to the outside through the exit surface 20.

That is, since the corner 11*c* of the light guide slit 11 is vertical in cross-section, the amount of total reflection of the light entering the light guide slit 11 is minimized to secure a sufficient amount of emission of light.

Meanwhile, the exit surface 20 has a plurality of cross-sectional parts 21 protruding in a direction of emission of light, and the cross-sectional parts 21 have different protruding lengths.

Accordingly, the light-distributing lens 1 enables the light from the exit surface 20 to be refracted and emitted in a specific direction.

The plurality of cross-sectional parts 21 of the exit surface 20 may be arranged in a left-right direction or in a vertical direction according to the direction of emission of light. That is, as can be seen in FIGS. 1 and 3, the individual cross-sectional parts 21 sequentially protrude forward as directed in a left or right direction or sequentially protrude forward as directed in an upward or downward direction. In the drawings, the individual cross-sectional parts 21 are illustrated as protruding longer as directed in a downward direction.

In this way, the constituent cross-sectional parts 21 of the light-distributing lens 1 allow lighting regions to be set differently from each other.

Accordingly, the plurality of light guide slits 11 may be arranged to match between the individual cross-sectional parts 21 of the exit surface 20.

That is, the light-distributing lens 1 may form a lighting region in a specific direction when the cross-sectional parts 21 are formed. However, as the individual cross-sectional parts 21 protrude to have different lengths, each of the cross-sectional parts 21 has an edge formed at the end thereof. The light efficiency at the edge of the cross-sectional part 21 is reduced as the light passing through the edge is scattered.

In addition, the plurality of cross-sectional parts 21 are stepped due to the different protruding lengths thereof, so that a straight flat part 22 may be formed at the connection between each of the cross-sectional parts 21 and a cross-sectional part 21 adjacent thereto. Thus, some of the light passing through each cross-sectional part 21, directed from bottom to top, may be reflected through the flat part 22 to travel in the main optical direction.

In this way, since the light-distributing lens 1 is configured such that the light guide slits 11 are arranged to match between the individual cross-sectional parts 21, the amount of light traveling between the individual cross-sectional parts 21 is reduced, thereby preventing a decrease in light efficiency.

As illustrated in FIG. 4, each light guide slit 11 may include a medium 30 having a low refractive index. The medium 30 may be made of a material having a lower refractive index than the light-distributing lens 1, and may be configured to absorb light.

Meanwhile, the lighting module according to the embodiment of the present disclosure, as illustrated in FIG. 5, includes a light source 100 configured to generate light, a first lens 200 on which the light generated by the light source 100 is incident and configured to change a travel direction of the light incident thereon, and a second lens 300 including an incident surface 310 on which the light having passed through the first lens 200 is incident and having at least one light guide slit 311 formed thereon, and an exit surface 320 through which the light is emitted, the light guide slit 311 allowing some of the incident light, directed upward or downward, to be refracted.

That is, in the present disclosure, the light source 100, the first lens 200, and the second lens 300 may be disposed in sequence, and the light source 100, the first lens 200, and the second lens 300 may be installed through a housing 400.

Here, the light source 100 may be an LED, and irradiates the first lens 200 with light.

The first lens 200 refracts the light emitted from the light source 100 to change the travel direction of the light. The first lens 200 may be a condensing lens, such as a projection lens with one surface or both surfaces protruding convexly or a Fresnel lens compressed in a plane direction.

The second lens 300 has the incident surface 310 and the exit surface 320 formed thereon, and the at least one light guide slit 311 is formed on the incident surface 310. The light guide slit 311 refracts some of the incident light, directed upward, to travel downward, and refracts some of the incident light, directed from top to bottom, to travel in a main optical direction.

To this end, the second lens 300 has the light guide slit 311 formed on the incident surface 310, so that the light directed from bottom to top is totally reflected in a straight section 311*b* of the light guide slit 311 to travel downward, and some of the light passing therethrough is totally reflected in an inclined section 311*a* to travel downward, thereby minimizing upward travel of light.

In addition, the light directed from top to bottom is refracted by the inclined section 311*a* of the light guide slit 311 to travel forward, thereby achieving an improvement in light efficiency.

To this end, the light guide slit 311 has the inclined section 311*a* extending obliquely in the central direction of the second lens 300 and the straight section 311*b* extending in a straight line.

That is, the light guide slit 311 is a portion cut to have the inclined section 311*a* and the straight section 311*b* on the incident surface 310 of the second lens 300, and defines a space with a low refractive index in the second lens 300.

In particular, the light guide slit 311 has the inclined section 311*a* inclined at the upper side thereof and the straight section 311*b* extending in the straight line at the lower side thereof, so as to refract light from the inclined section 311*a* and the straight section 311*b*, thereby minimizing upward travel of light.

Here, the inclined section 311*a* of the light guide slit 311 may have an angle of inclination determined based on the travel path of light due to characteristics of the light source 100 or the first lens 200.

Meanwhile, a position where the light guide slit 311 is formed may be determined as follows.

The position where the light guide slit 311 is formed may be determined according to the refractive index of the second lens 300 and the angle at which the light having passed through the first lens 200 is totally reflected in a vertical direction when incident on the incident surface 310.

That is, the light guide slit 311 may be formed at a point of the boundary between total reflection and refraction on the incident surface 310 of the second lens 300.

When the light having passed through the first lens 200 is incident on the second lens 300, the larger an angle of incidence, the more difficult it is to induce total reflection. Therefore, it is assumed that the angle of incidence along the travel path of the light, having the largest angle of incidence, incident on the incident surface 310 of the second lens 300 is θ.

Here, θ is changed depending on the refractive index of the second lens 300, and is assumed to be 1.5.

Assuming that the incident surface 310 of the second lens 300 is vertical, an angle of incidence of light $\theta_1$ that is perpendicular to 90° may be derived according to Snell's law.

Snell's law is as illustrated in FIG. 6, and the equation thereof is as follows.

$$a = n_1 \sin\theta_1$$

$$a = n_2 \sin\theta_2$$

$$n_1 \sin\theta_1 = n_2 \sin\theta_2$$

$$\frac{\sin\theta_1}{\sin\theta_2} = \frac{n_2}{n_1}$$

That is, it is a ratio of lengths of n1 and n2, n2/n1 may be derived as the refractive index.

Through the equation, based on Snell's law, $$\frac{\sin\theta_1}{\sin\theta_2} = 0.667,$$

and When $\theta_2$ is 90°, $\theta_1$ becomes 41.8°.

Eventually, as tan 41.8°=b/a, a proportional expression of 0.89a=b is attained.

Accordingly, as illustrated in FIG. 7, when the value of L1 is set according to the optical performance, the value of the height L2 of the light guide slit 311 may be determined in the second lens 300.

As such, if the equation is reconstructed with the refractive index N, L2=L1*tan($\sin^{-1}$N) is attained.

Accordingly, when the second lens 300 having a refractive index of 1.5 is used, the light that has passed through the first lens 200 at an angle of incidence greater than 41.8° is totally reflected so that harmful light is reduced when a low beam is implemented.

On the other hand, the light that has passed through the first lens 200 at an angle of incidence smaller than 41.8° is transmitted to be incident on the light guide slit 311. Some of the transmitted light is totally reflected in the inclined section 311*a* to travel downward while only the remaining light travels upward, thereby minimizing upward travel of light.

In this way, the second lens 300 consists of a plurality of second lenses formed beneath the determined light guide slit 311 to minimize light traveling above the cut-off line when implementing a low beam, thereby improving light performance.

In addition, even if the output of the light source 100 is increased to secure a sufficient amount of light, the amount of light is increased with the intended beam pattern according to the implementation of the low beam and light traveling above the cut-off line is minimized. Thus, even if the amount of light is increased, unintentional generation of light is minimized and overall light performance is enhanced.

The light-distributing lens having the above-mentioned structure and the lighting module using the same can secure light efficiency when implementing the low beam and have enhanced light performance by minimizing unintentional generation of light.

As is apparent from the above description, according to the light-distributing lens having the above-mentioned structure and the lighting module using the same, it is possible to secure light efficiency when implementing the low beam and enhance light performance by minimizing unintentional generation of light.

Although specific embodiments of the present disclosure have been disclosed for illustrative purposes, those having ordinary skill in the art will appreciate that various modifications, additions and substitutions are possible, without departing from the scope and spirit of the present disclosure.

What is claimed is:

1. A light-distributing lens comprising:

an incident surface on which light from a light source is incident and having at least one light guide slit formed thereon; and an exit surface through which the light is emitted, wherein the at least one light guide slit is configured to cause some of the incident light, directed upward or downward, to be emitted in a main optical direction, wherein the at least one light guide slit comprises:

an inclined section inclined in a central direction of the light-distributing lens; and a straight section extending in a straight line; and a corner section to which the inclined section and the straight section are connected, and wherein:

the corner section is vertical in cross-section and configured to extend in a straight line between the inclined section and the straight section, the exit surface has a plurality of cross-sectional parts, and the at least one light guide slit includes a plurality of light guide slits arranged to match between individual cross-sectional parts of the exit surface wherein the plurality of cross-sectional parts of the exit surface protrudes in a direction of emission of light, and the cross-sectional parts have different protruding lengths.

2. The light-distributing lens according to claim 1, wherein the inclined section has an angular gradient such that the light directed from top to bottom or from bottom to top is refracted and emitted in the main optical direction.

3. The light-distributing lens according to claim 1, wherein the at least one light guide slit comprises a medium having a low refractive index.

4. A light-distributing lens comprising:

an incident surface on which light from a light source is incident and having at least one light guide slit formed thereon; and an exit surface through which the light is emitted, wherein the at least one light guide slit is configured to cause some of the incident light, directed upward or downward, to be emitted in a main optical direction, wherein the at least one light guide slit comprises:

an inclined section inclined in a central direction of the light-distributing lens; and a straight section extending in a straight line; and a corner section to which the inclined section and the straight section are connected, and wherein:

the corner section is vertical in cross-section and configured to extend in a straight line between the inclined section and the straight section, the exit surface has a plurality of cross-sectional parts protruding in a direction of emission of light, and the cross-sectional parts have different protruding lengths, and the plurality of cross-sectional parts are stepped due to the different protruding lengths thereof, so that a straight flat part is formed at a connection between each of the cross-sectional parts and a cross-sectional part adjacent thereto wherein the plurality of cross-sectional parts of the exit surface protrudes in a direction of emission of light, and the cross-sectional parts have different protruding lengths.

5. A lighting module comprising:

a light source configured to generate light;

a first lens on which the light generated by the light source is incident and configured to change a travel direction of the light incident thereon; and at least one second lens comprising:

an incident surface on which the light having passed through the first lens is incident and having at least one light guide slit formed thereon; and an exit surface through which the light is emitted, the at least one light guide slit configured to cause some of the incident light, directed upward or downward, to be refracted, wherein the at least one light guide slit comprises:

an inclined section inclined in a central direction of the at least one second lens;

a straight section extending in a straight line; and a corner section to which the inclined section and the straight section are connected, and wherein:

the corner section is vertical in cross-section and configured to extend in a straight line between the inclined section and the straight section, the exit surface has a plurality of cross-sectional parts, and the at least one light guide slit includes a plurality of light guide slits arranged to match between individual cross-sectional parts of the exit surface wherein the plurality of cross-sectional parts of the exit surface protrudes in a direction of emission of light, and the cross-sectional parts have different protruding lengths.

6. The lighting module according to claim 5, wherein a position where the at least one light guide slit is formed is determined according to a refractive index of the at least one second lens and an angle at which the light having passed through the first lens is totally reflected in a vertical direction when incident on the incident surface.

7. The lighting module according to claim 6, wherein the at least one second lens include a plurality of second lenses formed beneath the determined light guide slit.

* * * * *